US006116162A

United States Patent [19]

Santa Cruz et al.

[11] Patent Number: 6,116,162

[45] Date of Patent: Sep. 12, 2000

[54] COMBINATION PROTECTIVE BUMPER AND PLACEMAT

[76] Inventors: Cathy D. Santa Cruz, 401 Canyon Way, #43, Sparks, Nev. 89434; John Kevin Henderson; Wendy L. Henderson, both of 159 Sand Dune Ct., Henderson, Nev. 89014

[21] Appl. No.: 08/947,960

[22] Filed: Oct. 9, 1997

[51] Int. Cl.[7] ..... A47B 95/00

[52] U.S. Cl. ..... 108/27; 108/90; 248/345.1

[58] Field of Search ..... 108/27, 90; 150/158; 211/119.003; 52/716.1, 716.8; 24/369, 370, 716; 248/345.1

[56] References Cited

U.S. PATENT DOCUMENTS

| | | | |
|---|---|---|---|
| 2,555,873 | 6/1951 | Clark | 108/27 |
| 3,915,528 | 10/1975 | Glickman | 108/90 X |
| 4,920,896 | 5/1990 | Holden | 108/90 |
| 5,036,777 | 8/1991 | Barton | 108/90 |

FOREIGN PATENT DOCUMENTS

| | | | |
|---|---|---|---|
| 984651 | 3/1965 | United Kingdom | 248/345.1 |

*Primary Examiner*—Jose V. Chen
*Assistant Examiner*—Janet M. Wilkens

[57] ABSTRACT

A protective bumper and placemat in combination which is removably attachable to substantially any furniture edge. The apparatus is washable, portable and sanitary, and allows a child when seated at a table, to enjoy eating on a sanitary surface, or the child may use the apparatus as a play surface.

14 Claims, 2 Drawing Sheets

COMBINATION PROTECTIVE BUMPER AND PLACEMAT

FIELD OF THE INVENTION

The present invention is related to protective pads used with furniture or the like, but more specifically pertains to a protective edge guard which is removably attachable to a table, in combination with a sanitary placemat.

BACKGROUND OF THE INVENTION

The present invention was conceived while dining at a restaurant with an infant. At which time the infant kept trying to chew on the table edge. Thus, we soon determined there was a need for some type of barrier, or covering which could be easily transported and removably attached to the table. Also, at that time it was contended that if we combined a placemat with the barrier, this would provide a sanitary eating surface as well, which proves to be most advantageous.

In the past, many types of protective edge pads have been taught within the prior art. As there is a great need to address and eliminate the numerous accidents incurred when small children accidentally fall against, or into the corners of furniture, or the like.

Therefore, many different types of apparatus's have been developed to resolve this problem. However, each have inherent disadvantages which the present invention addresses and overcomes. For example, U.S. Pat. Nos. 4,582,739, and 4,817,902, each provide and teach a corner protector. However, each are limited in use as they can only be attached to the corner structure and thus are not applicable for use on furnishings having a circular or oval shaped edge, or the like. Furthermore, neither apparatus addresses or suggests that it may be used to cover not only the corner edges of furniture, but a large portion of the table surface as well. Such as taught by the present invention which is most advantageous, as will later be seen.

Other types of protective edge bumpers include U.S. Pat. Nos. 4,810,550, 4,117,782 and 4,153,230, all of which pertain to bumpers for table games or the like. Again, these bumpers are only functional for use on corners and are not functional for use as a placemat, as is the present invention.

SUMMARY OF THE INVENTION

The present invention not only resolves the noted problems associated with all of the prior art, but further addresses the need for a table edge guard, or bumper, having a place-mat in combination therewith. This unique combination provides unusual results not found within the prior art, and nowhere in the prior art has such a combination been taught or suggested.

Therefore, it is an object of the present invention to provide a combination protective bumper and placemat. It is to be noted this combination provides unusual results. For example, a child or toddler when seated in a tray-less highchair or the like, with the chair being positioned next to the edge of a table, most often the child will be tempted to chew on the table edge. Or, the child may accidentally injure themselves while bumping into the edge or corner. Or the child may accidentally scratch or mar the surface of the table, etc.

Therefore, it is contended by the applicants that a combination protective bumper pad and placemat would be most advantageous and would eliminate the above noted difficulties. For example, the present invention serves as a placemat for self-feeding children, and keeps toddlers from chewing on, or bumping themselves on the table edge. Also, the present invention protects the table from harm, and most important it provides a sanitary eating surface.

Another object of the present invention is to provide in combination a protective bumper and placemat which is reusable, is water resistant, is made from a non-toxic material and is washable.

A further object of the present invention is to provide in combination a protective bumper and placemat which is removably attachable to substantially any suitable table of choice, including various shaped tables, such as oval, round square, rectangular or even octagon, etc.

Yet another object of the present invention is to provide in combination a protective bumper and placemat which is completely portable.

Still another object of the present invention is to provide in combination a protective bumper and placemat which is substantially adjustable, and is removably attachable to various tables having different widths.

Yet another object of the invention is to provide in combination a protective bumper and placemat wherein the bumper, or cover member, is substantially made from any suitable material of choice, such as vinyl or the like, which is washable, non-toxic, water-resistant, etc.

Still a further object of the invention is to provide in combination a protective bumper and placemat wherein the bumper includes any suitable cushioning of choice therein, such as any typical padding that is non-toxic and washable, or the like.

Yet another object of the invention is to provide in combination a protective bumper and placemat which further includes means to adjustably attach and removably affix the bumper to the table. For example, the preferred embodiment teaches two inserts, each of which are adjustably positioned within the bumper, and removably contained within the bumper. The inserts are substantially flexible or moldable, and are of a shape and size to substantially grasp the table. Whereby, a small child could not easily remove the bumper from the table. Again, the inserts can be made from substantially any suitable material of choice, such as plastic, aluminum, copper, etc.

Still further, it is another object of the present invention to provide in combination a protective bumper and placemat wherein the above noted inserts may be easily removed and replaced repeatedly. Such as the bumper may include two slits for slidably receiving the inserts, and the slits include any suitable fastener means of choice. For example, a loop and pile fastener such as VELCRO is most efficient, but it is to be noted any suitable fastener is acceptable, as long as it is substantially safe and child-proof.

Also a further object of the present invention is to provide in combination a protective bumper and placemat which provides substantial protection for the table.

Yet another object of the present invention is to provide in combination a protective bumper and placemat which provides substantially a sanitary eating surface.

Also, a very important object of the present invention is to provide in combination a protective bumper and placemat which does not have any sharp edges or protrusions which may injure an infant.

Yet another object of the present invention is to provide in combination a protective bumper and placemat which is of a sufficient size to cover substantially at least a portion of the table which is within arms reach of a toddler when seated at the table.

Another object of the present invention is to provide in combination a protective bumper and placemat which is of simple design, is inexpensive to manufacture, is rugged in construction, is easy to use and efficient in operation.

Yet another object of the present invention is to provide in combination a protective bumper and placemat wherein the bumper material may include indicia which is related to children, such as cartoon characters, or the like.

Still another object of the present invention is to provide in combination a protective bumper and placemat and a method of use therefore.

Other objects and advantages will be seen when taken into consideration with the following specification and drawings.

DETAILED DESCRIPTION OF THE DRAWINGS

Referring now in detail to the drawings wherein like characters refer to like elements throughout the various drawings.

Figure 1:
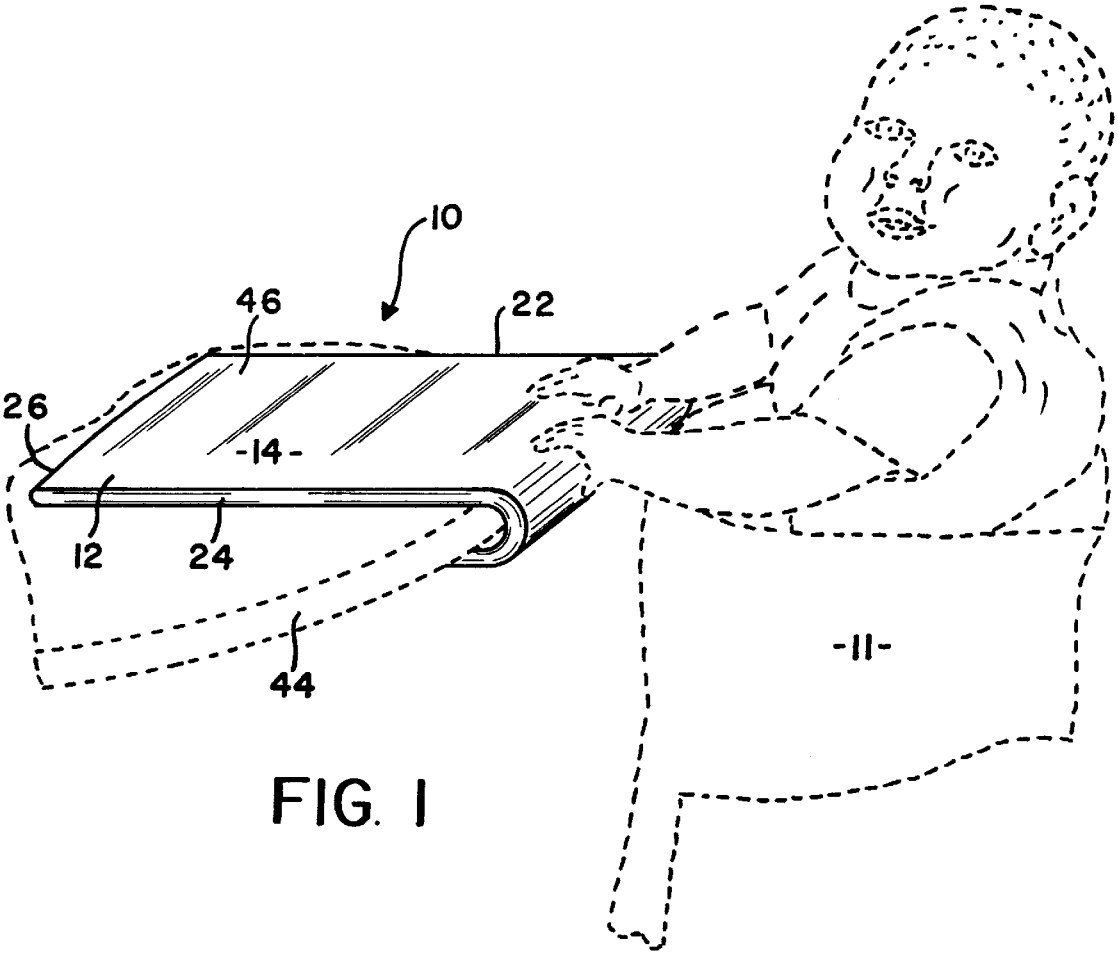
FIG. 1 is substantially an overview of the present invention, which is a combination protective bumper and placemat.
Figure 3:
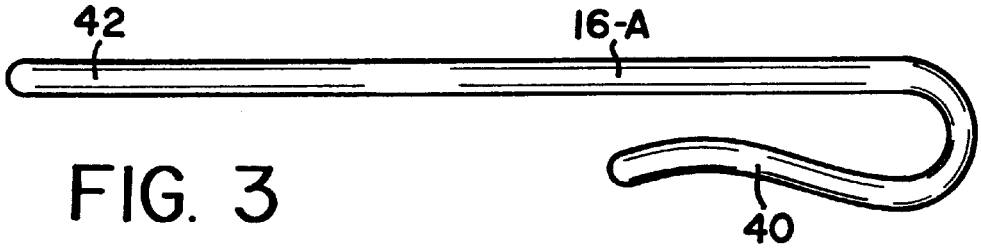
FIG. 3 is substantially an edge view of FIG. 2.
Figure 4:
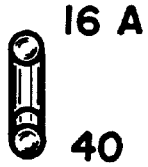
FIG. 4 is substantially an end view of FIG. 3.
Figure 6:
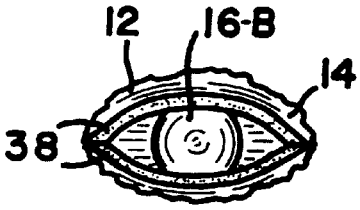
FIG. 6 is substantially a partial exploded view showing an open position for a loop and pile fastener.

Within FIG. 1, (arrow 10) substantially represents an overview of the preferred embodiment for the present invention, which is substantially a combination protective bumper and placemat (12), comprising of substantially an elongated cover member (14), a first insert (16-A), as shown in FIG. 3, and a second insert (16-B) as partially shown in FIG. 6.

It is to be noted that plan view as shown in FIG. 1, substantially exemplifies a child being seated at a prior art tray-less highchair (11), which can be substantially any suitable chair of choice, with the combination bumper and placemat (12) being removably but fixedly attached to a prior art table edge (44).

It is to be further noted that substantially any suitable various shaped table edge may be used, such as a round edge, oval, square, etc.

Referring now to cover member (14) which is substantially made from any suitable material of engineering choice which is washable and water resistant, for example it may be made from plastic tablecloth-like material, coated plastic, etc., or as we show within the preferred embodiment, vinyl. Cover member (14) can also be formed into substantially any suitable size or shape of engineering choice, but the applicants have found the following dimensions to be most satisfactory. However, it is to be understood these dimensions are only exemplary and the present invention is not to be limited to such dimensions.

Figure 5:
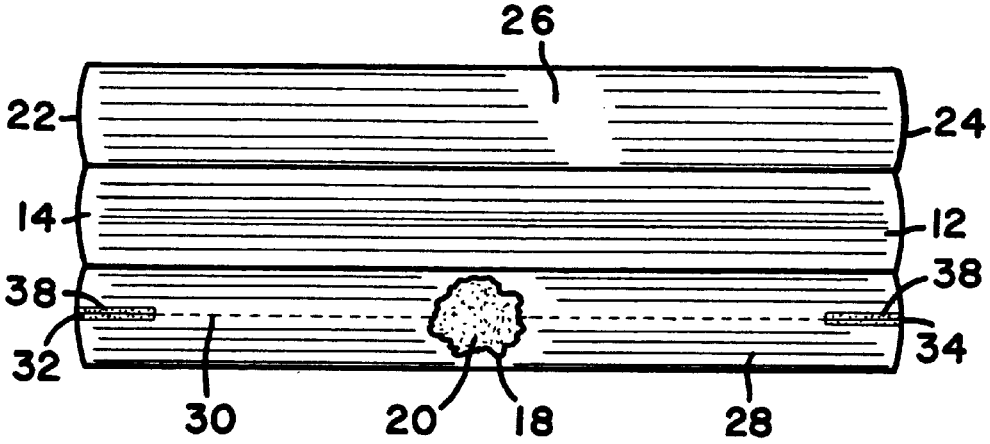
FIG. 5 is substantially an end view of FIG. 2.

Cover member (14) is formed from a piece of vinyl measuring approximately 16"×40" which when folded over provides an interior cavity (18) (as shown in FIG. 5.) which is of a size and shape to receive a section of padding (20) therein.

It is to be noted that cover member (14) may include indicia (15) thereon, such as cartoon characters, or the like.

It is to be further noted that cover member (14) provides unusual results if manufactured without padding (20). For example, this type of embodiment (as substantially shown in FIG. 1) wherein the padding (20) is eliminated, also provides a removable washable play surface (14) for older children when seated at a table (44), or the like. As it is well known that children can be quite messy when they are at play, and thus it would be advantageous to provide a suitable removable washable surface whereon they are allowed to play, and engage in various activities such as drawing, coloring, finger painting, etc. Whereby, the child or guardian need not worry about the table (44) being harmed in any manner while the child is at play.

Figure 2:
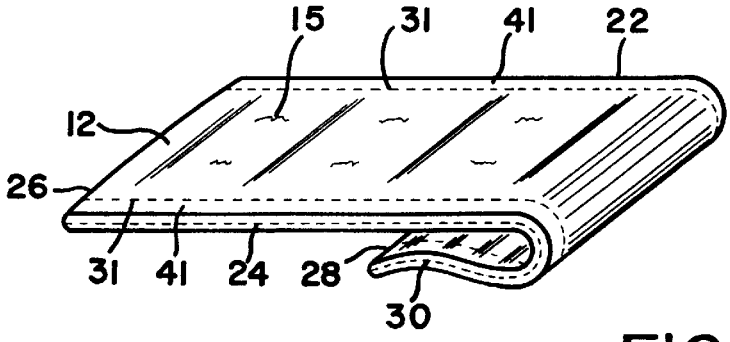
FIG. 2 is substantially a perspective view of the present invention.

Referring now to FIG. 2, wherein we show that any suitable type of padding (20) of engineering choice may be used and may be of any suitable size or shape. For example, within the preferred embodiment, padding (20) measures approximately 15"×19" having a thickness of approximately ½" or ¼", respectively.

Cover member (14) can be fabricated by any suitable means of engineering choice. For example, cover member (14) when folded over, provides a first and a second exterior long edge (22 & 24), respectively, a short folded edge (26) and an exterior short edge (28), with the first and second long edges (22 & 24) being substantially opposed to each other.

After padding (20) has been positioned within cavity (18), cover member (14) may then be fixedly secured by any suitable means of engineering choice, such as by stitching (30) which is substantially applied to each exterior long edge (22 & 24) respectively, and exterior short edge (28) respectively. However, exterior short edge (28) is not stitched completely, so as to provide substantially a first slit (32) and substantially a second slit (34), with first slit (32) and second slit (34) being substantially spaced apart from each other. Therefore, cover member includes means to removably slidably receive a first insert (16-A) longitudinally within first long edge (22), and means to removably slidably receive a second insert (16-B) longitudinally within second long edge (24). It is to be noted that any suitable means of engineering choice may be used to slidably receive each insert (16-A & 16-B), but the applicants have found slits (32 & 34) to be most satisfactory.

Furthermore, cover member (12) may include additional stitching (31) as shown in FIG. 2, which provides additional strength but most importantly substantially forms a first and a second guide sleeve (41) for slidably receiving and removably retaining inserts (16-A & 16-B) therein.

It is to be noted that first slit (32) and second slit (34) each may include any suitable fastener means of engineering choice. For example, a fastener means of the loop and pile variety, such as VELCRO (38) is most effective, as shown in FIGS. 5 & 6. It is to be noted VELCRO (38) is shown in a closed position within FIG. 5, and in FIG. 6 VELCRO (38) is shown in an open position.

Referring now to FIGS. 5 & 6, wherein we show first and second inserts (16-A & 16-B), which are substantially identical, and each of which are substantially shaped in the form of a "J", thus providing substantially a hook shaped portion (40) and substantially a long leg (42). Hook shaped portion (40) is substantially of a shape and size to adjustably removably slidably receive substantially a table edge (44) therein. It is to be noted that inserts (16-A & 16-B) may be of any suitable size and shape of choice. However, the preferred embodiment as we have herein shown proves to be most effective as due to the shape, the inserts (16-A & 16-B)

actually grasp and apply tension to the table edge (44) in a removable but very secure manner, which is not easily removed by a child.

It is to be further noted that inserts (16-A & 16-B) can again be made from substantially any suitable material of engineering choice, such as plastic, aluminum or the like. However applicants have found that inserts (16-A & 16-B) which are made from PLEXIGLASS or any other suitable plastic material, and measure approximately 19 inches in length and which are then heated and bent over approximately 4 inches from one end, which substantially forms hook portion (40), proves to be highly effective and provides efficient gripping strength.

It will now be seen when inserts (16-A & 16-B) have been inserted and positioned within each long edge (22 & 24), cover member (14) now becomes substantially rigid, respectively. Whereby, when the table edge (44) is slidably positioned within each hook portion (40) of each insert (16-A & 16-B) simultaneously, cover member (14) is now fixedly yet removably attached to table edge (44), and long leg (42) lies relatively flat upon the top surface of the table, thus long leg (42) provides substantially an exposed surface (46) which is most suitable for use as a placemat and which can easily be cleaned, thus providing a sanitary placemat.

We also provide a method for attaching a combination protective bumper and placemat (12) to an exposed edge of a table (44), comprising the steps of:

a. positioning a cover member into substantially a flat open position;

b. grasping a first substantially hook-shaped insert (16-A);

c. locating a first slit (32) within cover member (14);

d. opening first slit (32);

e. positioning first insert (16-A) within first slit (32);

f. sliding insert (16-A) into first slit (32) until insert (16-A) is completely captured within cover member (14);

g. grasping a second substantially hook-shaped insert (16B);

h. locating a second slit (34) within cover member (14);

i. opening second slit (34);

j. positioning second insert (16-B) within second slit (34);

k. sliding second insert (16-B) into second slit (34) until second insert (16-B) is completely captured within cover member (14);

l. positioning combination protective bumper and placemat (12) next to exposed edge (44) of a table with each hook-shaped insert (16-A & 16-B) being substantially in alignment with exposed edge (44) of the table; and m. sliding combination protective bumper and placemat (12) over exposed edge (44) of the table;

whereby;

exposed edge (44) of the table is slidably captured within each insert (16-A & 16-B) and combination protective bumper and placemat (12) is fixedly removably attached to the table.

It will now be seen we have herein provided a combination protective bumper and placemat which provides most unusual results and most importantly it also provides a sanitary eating surface.

It will further be seen that we have herein provided in combination a protective bumper and placemat which is reusable, is water resistant, is made from a non-toxic material and is washable.

It will also be seen that we have herein provided in combination a protective bumper and placemat which is removably attachable to substantially any suitable table of choice, including various shaped tables, such as oval, round square, rectangular or even octagon, etc.

It will further be seen that we have herein provided in combination a protective bumper and placemat which is completely portable.

It will also be seen that we have herein provided in combination a protective bumper and placemat which is substantially adjustable, and is removably attachable to various tables having different widths.

It will further be seen that we have herein provided in combination a protective bumper and placemat which in a second embodiment may be used as a suitable, washable play surface for older children.

It will also be seen that we have herein provided in combination a protective bumper and placemat wherein the bumper includes any suitable cushioning or padding of choice therein.

It will also be seen that we have herein provided in combination a protective bumper and placemat which further includes means to adjustably attach and removably affix the bumper to the table.

It will further be seen that we have herein provided in combination a protective bumper and placemat wherein the above noted inserts may be easily removed and replaced repeatedly.

It will also be seen that we have herein provided in combination a protective bumper and placemat which is safe and child-proof.

It will also be seen that we have herein provided in combination a protective bumper and placemat which provides substantial protection for the table.

It will further be seen that we have herein provided in combination a protective bumper and placemat which does not have any sharp edges or protrusions which may injure an infant.

It will also be seen that we have herein provided in combination a protective bumper and placemat which is of simple design, is inexpensive to manufacture, is rugged in construction, is easy to use and efficient in operation.

It will further be seen that we have herein provided in combination a protective bumper and placemat wherein the bumper material may include indicia which is related to children, such as cartoon characters, or the like.

Although the invention has been herein shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus's.

Having described our invention, what we claim as new and desire to secure by Letters Patent is:

1. A method for attaching a combination protective bumper and placemat to an exposed edge of a table, comprising the steps of:

a. positioning a cover member into substantially a flat open position;

b. grasping a first substantially hook-shaped insert;

c. locating a first slit within said cover member;

d. opening said first slit;

e. positioning said insert within said first slit;

f. sliding said insert into said first slit until said insert is completely captured within said cover member;

g. grasping a second substantially hook-shaped insert;

h. locating a second slit within said cover member;

i. opening said second slit;

j. positioning said second insert within said second slit;

k. sliding said second insert into said second slit until said second insert is completely captured within said cover member;

l. positioning said combination protective bumper and placemat next to said exposed edge of said table with each said hook-shaped insert being substantially in alignment with said exposed edge of said table; and m. sliding said combination protective bumper and placemat over said exposed edge of said table;

whereby;

said exposed edge of said table is slidably captured within each said insert and said combination protective bumper and placemat is fixedly removably attached to said table.

2. Combination protective bumper and placemat comprising: an elongated cover member; a first insert; and a second insert; said cover member having an interior cavity, a first exterior long edge which is substantially opposed to a second exterior long edge, a short folded edge and an exterior short edge, said cover member having means to removably slidably receive said first insert longitudinally within said first long edge, said cover member having means to removably slidably receive said second insert longitudinally within said second long edge, said first and said second insert each being shaped in the form of a "J", thus providing a hook shaped portion and a long leg, said hook shaped portion being of a shape and size to adjustably removably slidably receive a table edge therein, and said first and said second insert being substantially aligned and opposed to each other, whereby;

when said table edge is positioned within said hook portion of each said insert simultaneously, each said long leg and said cover member in combination provide an exposed flat surface suitable for use as a placemat.

3. The protective bumper and placemat of claim 2 wherein said cover member further serves as a removable washable play surface for children.

4. The protective bumper and placemat of claim 2 wherein said cover member is made from padded material.

5. The protective bumper and placemat of claim 2 further includes padding fixedly positioned within said cavity.

6. The protective bumper and placemat of claim 2 wherein said cover member is made from vinyl.

7. The protective bumper and placemat of claims 2 wherein said first and said second insert are made from plastic.

8. The protective bumper and placemat of claim 2 wherein said first and said second insert are made from aluminum.

9. The protective bumper and placemat of claim 2 wherein said cover member further includes indicia thereon.

10. The protective bumper and placemat of claim 2 wherein said cover member is washable.

11. The protective bumper and placemat of claims 2 wherein said cover member is water-resistant.

12. The protective bumper and placemat of claim 2 wherein said means to removably slidably receive said first insert longitudinally within said first long edge is by a first slit provided on said exterior short edge, said means to removably slidably receive said second insert longitudinally within said second long edge is by a second slit provided on said exterior short edge, said first and said second slit being spaced apart from each other, and said cover member includes stitching which forms a first and a second guide sleeve for slidably receiving and removably retaining said first and said second insert therein.

13. The protective bumper and placemat of claim 12 wherein said first and said second slit each include fastener means.

14. The protective bumper and placemat of claim 13 wherein said fastener means is of the loop and pile variety.

* * * * *